US011850632B2

(12) United States Patent
Eixelberger et al.

(10) Patent No.: US 11,850,632 B2
(45) Date of Patent: Dec. 26, 2023

(54) SCREENING DEVICE

(71) Applicant: BINDER + CO AG, Gleisdorf (AT)

(72) Inventors: Rainer Eixelberger, Gleisdorf (AT); Bernhard Timischl, Sinabelkirchen (AT); Franz Anibas, Gleisdorf (AT); Christian Url, Edelsbach (AT); Ermin Delibasic, Gössendorf (AT)

(73) Assignee: BINDER + CO AG, Gleisdorf (AT)

( * ) Notice: Subject to any disclaimer, the term of this patent is extended or adjusted under 35 U.S.C. 154(b) by 42 days.

(21) Appl. No.: 17/599,289

(22) PCT Filed: Mar. 30, 2020

(86) PCT No.: PCT/EP2020/058979
§ 371 (c)(1),
(2) Date: Sep. 28, 2021

(87) PCT Pub. No.: WO2020/201220
PCT Pub. Date: Oct. 8, 2020

(65) Prior Publication Data

US 2022/0168779 A1 Jun. 2, 2022

(30) Foreign Application Priority Data

Mar. 29, 2019 (EP) ..... 19166047

(51) Int. Cl.
*B07B 1/48* (2006.01)

(52) U.S. Cl.
CPC ..... *B07B 1/485* (2013.01)

(58) Field of Classification Search
CPC ..... B07B 1/48; B07B 1/485
(Continued)

(56) References Cited

U.S. PATENT DOCUMENTS 3,633,745 A * 1/1972 Wehner ..... B07B 1/485 209/325
3,647,068 A * 3/1972 Wehner ..... B07B 1/485 209/310

(Continued)

FOREIGN PATENT DOCUMENTS

AT 379 088 11/1985
AT 411874 B * 6/2004 ..... B07B 1/485

(Continued)

OTHER PUBLICATIONS

First Office Action conducted in counterpart Japan Appln. No. 2021-551923 (dated Mar. 22, 2022) (w/ translation).

(Continued)

*Primary Examiner* — Terrell H Matthews
(74) *Attorney, Agent, or Firm* — GREENBLUM & BERNSTEIN, P.L.C.

(57) ABSTRACT

A screening device having a first oscillating body with first cross members and a second oscillating body with second cross members. The first and second cross members are arranged alternately to a screening surface and each includes clamping devices via which screen linings forming the screening surface are each clamped between a first cross member and a second cross member. The first and second oscillating bodies are set in oscillation relative to one another to alternately compress and expand the screen linings. The first oscillating body includes a first pair of push rods on which the first cross members are arranged and the second oscillating body includes a second pair of push rods on which the second cross members are arranged. A stationary support structure accommodates the two oscillating bodies. The first and second oscillating bodies are set in oscillation relative to the stationary support structure.

18 Claims, 11 Drawing Sheets

(58) Field of Classification Search
USPC ..... 209/310
See application file for complete search history.

(56) References Cited

U.S. PATENT DOCUMENTS

| | | | | |
|---|---|---|---|---|
| 4,430,211 | A * | 2/1984 | Martin | B07B 1/50 209/403 |
| 4,581,132 | A | 4/1986 | Fritz et al. | |
| 5,037,535 | A * | 8/1991 | Bruderlein | B07B 1/485 209/325 |
| 2013/0126398 | A1* | 5/2013 | LaVeine | B07B 1/28 198/771 |

FOREIGN PATENT DOCUMENTS

| | | | | |
|---|---|---|---|---|
| DE | 1 206 372 | | 12/1965 | |
| DE | 24 25 953 | | 12/1975 | |
| EP | 0 099 528 | | 2/1984 | |
| EP | 0099528 | A2 * | 2/1984 | B07B 1/46 |
| EP | 3714996 | A1 * | 9/2020 | B07B 1/485 |
| FR | 1605322 | | 8/1974 | |
| JP | S59-069180 | | 4/1984 | |
| SU | 1050763 | | 10/1983 | |
| SU | 1111838 | | 9/1984 | |
| SU | 1540870 | | 2/1990 | |
| WO | 2013/078137 | | 5/2013 | |

OTHER PUBLICATIONS

Office Action conducted in counterpart Russia Appln. No. 2021125538/03 (dated Mar. 23, 2022) (w/ translation).
Examination Report conducted in counterpart India Appln. No. 202117047084 (dated Mar. 30, 2022) (w/ translation).
Int'l Search Report (Form PCT/ISA/210) conducted in Int'l Appln. No. PCT/EP2020/058979 (dated Sep. 7, 2020).
Int'l Written Opinion (Form PCT/ISA/237) conducted in Int'l Appln. No. PCT/EP2020/058979 (dated Sep. 7, 2020).
Int'l Prelim. Exam. Rpt. (Forms PCT/IPEA/416 & 409) conducted in Int'l Appln. No. PCT/EP2020/058979 (dated Mar. 2, 2021).

* cited by examiner 7
8
4a
4a
4a
x
x
x
S1
S2

7
8
4a
4a
4a
x1
x2
x1
S1
S2
a
a 7
8
4a
4a
4a
x2
x1
x2
S1
S2
a
a

SCREENING DEVICE

FIELD OF THE INVENTION

The invention relates to a screening device having a first oscillating body comprising first cross members and a second oscillating body comprising second cross members, wherein first cross members and second cross members are arranged alternately and preferably transversely to a screening surface and each comprise clamping devices via which screen linings which form the screening surface are each clamped, or can be clamped, between a first cross member and a second cross member, and first and second oscillating bodies can be set in oscillation relative to one another in order to alternately compress and expand the screen linings, wherein the first oscillating body comprises a first pair of push rods on which the first cross members are arranged and the second oscillating body comprises a second pair of push rods on which the second cross members are arranged.

Screening devices of this type are characterized by the use of flexible screen linings which are alternately compressed and expanded, and are used wherever conventional screening devices with rigid screen linings jam and clog up.

In order to compress and expand the screen linings, each screen lining of the screening surface, which is formed by multiple screen linings, is clamped in between two cross members that normally run transversely to the screening surface. One of these two cross members is thereby part of a first oscillating body; the other cross member is part of a second oscillating body. The two oscillating bodies oscillate against one another in a relative and phase-shifted manner, whereby the compression and expansion of the screen linings is effected.

In order to set the cross members of the two oscillating bodies in oscillation, said cross members are each interconnected at the ends thereof via a connecting part, that is, the one ends of the first cross members and the other ends of the first cross member of the first oscillating body are each interconnected. In addition, the one ends of the second cross members and the other ends of the second cross members of the second oscillating body are each interconnected. The connecting part is normally screen walls of a screen box. One screen box is thereby springably mounted, and therefore such that it can oscillate, on a machine foundation, whereas the other screen box is supported springably or elastically on the screen box mounted on the machine foundation.

A drive, normally an unbalance drive, sets one of the screen boxes, and thus an oscillating body, in oscillation, whereby the other screen box also oscillates. The springable or elastic mounting of the one screen box on the other is thereby coordinated such that the two screen boxes (oscillating bodies) oscillate relative to one another in a phase-shifted and opposing manner.

A screening device of this type is known from DE 1 206 372, for example. The device is composed of two oscillating bodies, in the form of screen boxes. Each oscillating body comprises one screen box each, as well as the cross members rigidly connecting the two screen walls of the screen box. To enable the relative motion of the first cross members of the first oscillating body relative to the second cross members of the second oscillating body, one oscillating body is springably mounted on the other oscillating body and is set in oscillation by means of a drive. Both oscillating bodies are positioned on a foundation in a collectively springable manner.

The screening device known from DE 24 25 953 has a similar design. There, the screen boxes, which can be moved relative to one another and comprise the cross members, are also collectively mounted directly on a machine foundation via spring elements.

From AT 379 088 B1, it is furthermore known to connect the cross members of one of the oscillating bodies to one another via what are referred to as push rods. Said push rods are elastically mounted on the screen walls of the screen box of the other oscillating body and can thus oscillate relative to said oscillating body in an opposing and phase-shifted manner in the direction of the screening surface. The screen box is vibrationally excited via a drive, and the entire system is mounted on a machine foundation via springs such that the system can oscillate.

What is problematic with these known screening devices are the large oscillating masses resulting from the fact that one or both of the oscillating bodies are in principle composed of a complete screen box, the screen walls of which are connected to one another by rigid cross members. In order to produce the oscillation of the cross members that is necessary for the compression and expansion of the screen mats, at least one of the screen boxes must therefore be set in oscillation. Due to the high mass of a screen box (up to 30 tons), a correspondingly high expenditure of energy is thus necessary for the drive. In addition, the forces transmitted to the machine foundation through the oscillation of the screen boxes are very high, as a result of which the machine foundation must have correspondingly generous dimensions. Also associated with this is the risk that vibrations transmitted to the machine foundation are carried over to other machines or parts of the building.

Screening devices are known which avoid this disadvantage in that a stationary support structure is provided on which the two oscillating bodies are arranged such that they can move relative to the support structure and can be set in oscillation. A screening device of this type is disclosed in U.S. Pat. No. 4,430,211, for example.

A disadvantage of this screening device, however, is the fact that the coupling to the stationary support structure on the one hand and of the oscillation systems to one another on the other hand is very complex, requires a plurality of components, and is therefore also maintenance-intensive.

Furthermore, the known coupling of the two oscillation systems to the stationary support structure is primarily designed to unburden the bearing means, but not to support the screening with a simultaneous conveying of the material being screened. Among other things, this results in the necessity of a steep inclination of the screening surface and, in addition, an oscillation of the two oscillation systems at a 40° oscillation angle does not allow an effective side seal of the screening surfaces, which in turn leads to increased screening losses.

Another problem of a fundamental nature is the fact that, in the feed region of the screening surface, there is normally a greater layer thickness than in the removal region. For this reason, it is very often necessary to ensure an appropriate material conveying specifically in the feed region, which is normally achieved through greater screening dynamics with large amplitudes. Particularly in the case of flip-flow screening machines, that is, screening machines in which the support structure is not stationary, but rather is also vibrationally excited and is therefore springably mounted on a machine foundation, these larger amplitudes can be effected in a relatively simple manner. But in the case of screening machines with a stationary support structure, a corresponding conveying capacity must be obtained by a greater machine or screening surface inclination, which, at the end of the screening machine where the material flow has already been markedly reduced due to the screening-out of the fine material, leads, however, to an excessively fast material transport and a large jumping height of the individual particles. This reduces the yield of fine material in the fine product. This could be counteracted by reducing the amplitude of the push rods, which results, however, in a further reduction in the material conveying in the feed region and thus to an overfilling of the screening machine. It is therefore known from the prior art to embody the push rods to be curved so that the inclination thereof to the removal region becomes smaller. However, for screening machines with a stationary support structure, an embodiment of this type is constructionally elaborate and cost-intensive.

The object of the present invention is therefore to avoid these disadvantages and to provide a screening device in which the machine foundation is subjected to the lowest possible loads on the one hand, but the conveying of the material being screened during the screening is optimized on the other hand, with a simple overall design.

At the same time, the possibility of achieving a good side seal through screen mats that are raised at the sides is to be provided.

A further object of the invention is to provide a screening device having a stationary support structure of the type named at the outset, which screening device enables a correspondingly adequate material conveying in the feed region, but allows a correspondingly reduced material conveying for this purpose in the removal region, and thereby has a simple design.

DESCRIPTION OF THE INVENTION

According to the invention, this object is attained with a screening device mentioned at the outset in that the first pair of push rods and the second pair of push rods are each coupled to the support structure via transversely elastic elements and are coupled to one another via transversely elastic elements, which transversely elastic elements each enable an oscillation in a coupling axis.

By coupling each push rod of a pair of push rods to a push rod of the other pair of push rods via transversely elastic elements, for example rubber blocks, and by simultaneously coupling each push rod of a pair of push rods to the support structure via transversely elastic elements, for example rubber blocks, a particularly simple design of the screening device can be achieved with a simultaneously good conveying of the material being screened. The coupling axis resulting from the use of the transversely elastic elements additionally makes it possible to size the support frame, for example the feet, accordingly based on the oscillation direction that occurs.

Furthermore, due to the solely linear opposing oscillating motion of the two oscillating bodies in the conveying direction of the feed material, an optimal side seal can be achieved with raised screen mats.

Preferably, the coupling axes of each transversely elastic element run essentially parallel to the push rods in order to optimally adapt the conveying of the material being screened to the progression of the screening surfaces, which likewise run essentially parallel to the push rods. However, it is also conceivable to fabricate the transversely elastic elements such that, in an installed state, coupling axes are produced which do not run parallel to the push rods. In this manner, the conveying speed of the material being screened can be slowed accordingly.

Particularly stable oscillation conditions are obtained if, according to a preferred embodiment of the invention, the two oscillating bodies are embodied with an equal mass. Particularly if only one drive motor that drives both oscillating bodies is provided, the equality of mass of the two oscillating bodies enables an exact, phase-shifted oscillation which helps to keep dynamic loads from being transmitted to the support structure. It should be noted that, in the present case, equality of mass is to be understood as a maximum difference of 7% between the masses of the two oscillating bodies, particularly preferably a maximum difference of 5%.

In another preferred embodiment of the invention, an eccentric drive is provided which drives both oscillating bodies via the respective pairs of push rods. For this purpose, both pairs of push rods are connected to one another via a drive shaft with eccentric bushings and connecting rods. The conditions are thus created for preventing the transmission of dynamic loads to the stationary support structure, and therefore to the machine foundation or the platform of a machine hall.

According to another preferred embodiment of the invention, it is provided that the eccentric drive is arranged on the first or second pair of push rods, whereby a particularly compact construction of the screening device results.

In this case, for the prevention of dynamic loads that are introduced into the machine foundation or the platform of a machine hall, it is provided according to another preferred embodiment of the invention that the oscillating body which does not bear the eccentric drive comprises an equalizing weight in order to compensate the surplus weight of the oscillating body which bears the eccentric drive.

According to another preferred embodiment of the invention, it is provided that, on the stationary support structure, material-feeding and/or material-removing system components, or means for attaching said system components, or dust-sealing system components are attached. In this case, it is possible to take advantage in particular of the fact that the support structure is stationary and does not move, and therefore that these system components can be attached to the support structure directly, without any spacing at all, and therefore in a dust-tight manner. By affixing means for attaching system components of this type to the support structure, wherein said means are preferably fabricated in one piece with the support structure, the subsequent mounting of system components of this type at the installation site can be simplified and/or sped up.

According to another preferred embodiment of the invention, it can be provided that the first and second oscillation systems each comprise groups of cross members arranged one below the other and, in order to form multiple screening surfaces running one below the other, screen linings are clamped on and between the cross members of groups of the first oscillating system and cross members paired therewith from groups adjacent thereto of the second oscillating system. The clamping thereby occurs such that a screen lining is clamped both on a topmost cross member of a group of the one oscillating system and also on a topmost cross member of a group adjacent thereto of the other oscillating system; an additional screen lining is clamped on and between other cross members of the two groups, which other cross members are arranged below said topmost cross members, etc. In this manner, multiple screening surfaces can be formed one below the other, wherein the statement "below" is not to be understood as meaning, relative to a working position of the screening device, an arrangement positioned vertically underneath said position; rather, a position arranged at a lower height in relation to the topmost cross members is to be understood.

According to a further preferred embodiment of the invention, it can thereby be provided that the cross members of each group are attached to mounting plates which are arranged such that they run essentially parallel to the support structure walls. One mounting plate of each group of cross members is thereby respectively located on each side of the screening surface, preferably in immediate proximity to the support structure wall arranged on the same side of the screening surface, wherein the term "support structure wall" is to be understood in a broad sense in the present case. Therefore, it cannot necessarily be considered that a support structure wall is embodied to be planar; rather, said wall can also be embodied in the form of a frame or frame profile and therefore may not exhibit a planar form in the conventional sense. The cross members of this group are secured to the inner side of the mounting plates, that is, on the side facing the screening surface. A securing pin is located on the outer side of the mounting plates, which pin is connected to a push rod of the same oscillating system. If the support structure wall is embodied to be planar, the connection occurs through an opening in said support structure wall.

According to another preferred embodiment of the invention, a third oscillating body comprising third cross members and a fourth oscillating body comprising fourth cross members are provided, wherein at least one additional screen lining is or can be clamped between a third cross member and a fourth cross member, and the third and fourth oscillating bodies can be set in oscillation relative to one another in order to alternately compress and expand the additional screen linings, wherein the third oscillating body comprises a third pair of push rods on which the third cross members are arranged and the fourth oscillating body comprises a fourth pair of push rods on which the fourth cross members are arranged, and the first pair of push rods and the third pair of push rods as well as the second pair of push rods and the fourth pair of push rods are elastically and/or springably connected to one another.

By providing two additional oscillating systems and elastically or springably coupling these two additional oscillating systems to the two other oscillating systems, it is possible to achieve screening surfaces with segments of different material conveying capacities in a stationary support structure, and to thus account for the fact that different screening dynamics (amplitudes) are necessary in the feed region and at the end of the screening machine. Through a corresponding design of the elastic or springable connection of the first oscillating system to the third oscillating system and the second oscillating system to the fourth oscillating system, or with a corresponding choice of the mass of the third and fourth oscillating systems, the amplitudes of the push rods of the third and fourth oscillating systems can be set to be different from the amplitudes of the first oscillating system and the second oscillating system. The amplitude of the removal-side push rods is preferably set to be smaller than that of the feed-side push rods. At this juncture, it should not go unmentioned that, in principle, additional oscillating systems can also be provided in the stationary support structure, which additional oscillating systems are connected to the third and fourth oscillating systems in the same way the third and fourth oscillating systems are connected to the first and second oscillating systems.

According to another preferred embodiment of the invention, it can be provided that one push rod of the first pair of push rods and one push rod of the second pair of push rods are each arranged in flush alignment with one another, and/or that one push rod of the second pair of push rods and one push rod of the fourth pair of push rods are each arranged in flush alignment with one another, whereby a particularly compact construction of the screening device is enabled and a correspondingly even screening surface formed by the individual screen linings is created.

According to another preferred embodiment of the invention, the third pair of push rods is coupled together with the fourth pair of push rods via transversely elastic elements, and/or the third and/or the fourth pair of push rods is respectively coupled to the support structure via transversely elastic elements. Reference has already been made above to the advantages of the use of transversely elastic elements.

The elastic and/or springable connection between the first pair of push rods and the third pair of push rods, and/or the second pair of push rods and the fourth pair of push rods can respectively occur, for example, by means of a tension-compression spring or by means of transversely elastic elements, depending on the requirement for the behavior of the third and fourth oscillating systems.

According to another preferred embodiment of the invention, multiple stationary support structures, such as those described above, are arranged such that they are positioned on top of one another.

BRIEF DESCRIPTION OF THE DRAWINGS

The invention will now be explained in greater detail, in a non-restrictive way, with the aid of exemplary embodiments as shown in the drawings.

The following are thereby shown:

FIG. 1 through FIG. 3 show schematic views of a screening device according to the invention with a first oscillating body S1 and a second oscillating body S2. First cross members 2 are part of the first oscillating body S1. Second cross members 3 are part of the second oscillating body.

Figure 1:
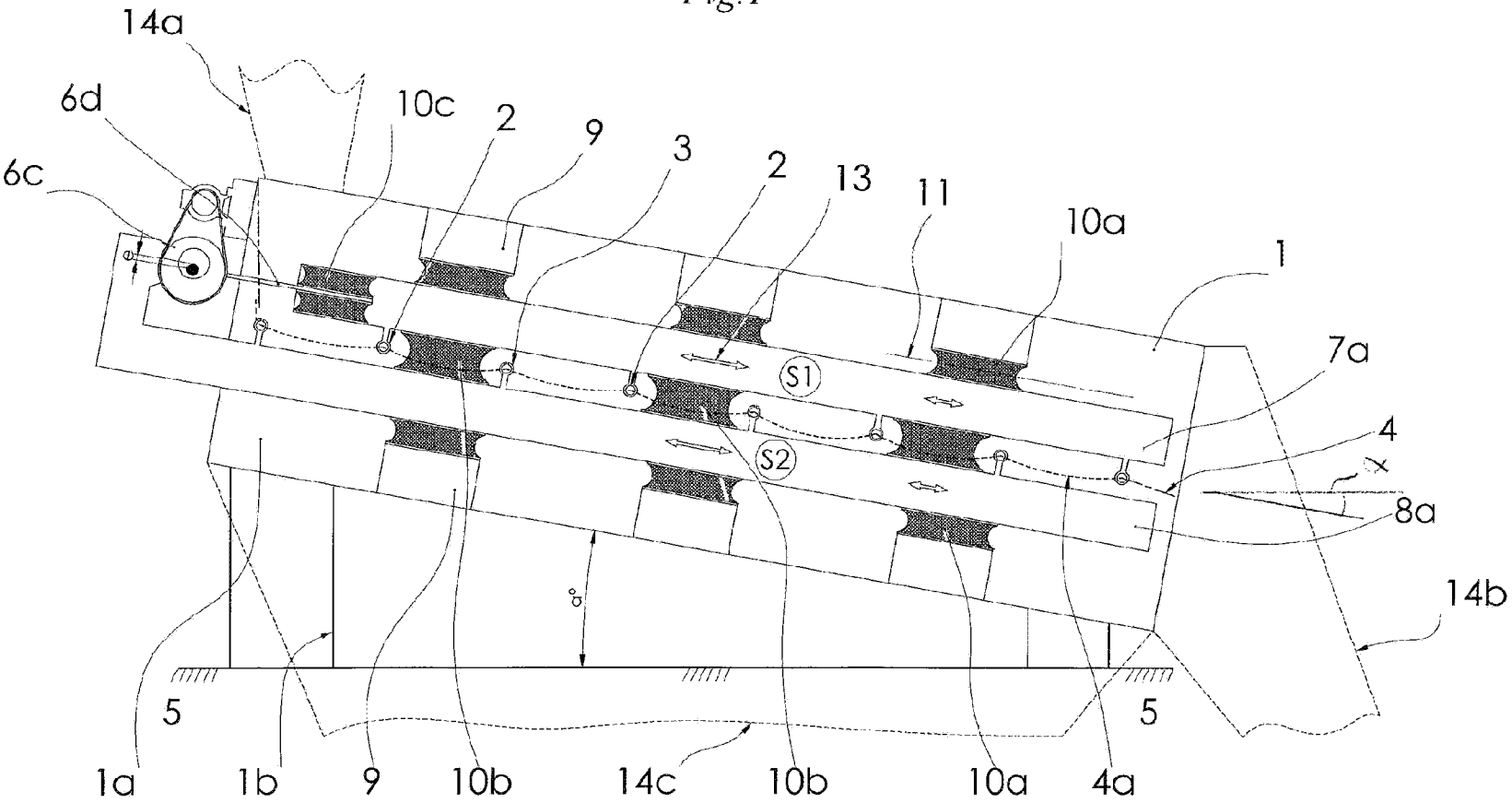
FIG. 1 A schematic side view of a screening device according to the invention FIG. 2 A schematic side view of a screening device according to the invention FIG. 3 A schematic top view of a screening device according to the invention FIG. 4 A detailed view of the vibratory drive FIGS. 5*a*-5*c* Schematic illustrations for the purpose of demonstrating the oscillating behavior FIG. 6 A schematic view of screening devices positioned on top of one another FIG. 7 A first alternative embodiment of a screening device according to the invention in a schematic side view FIG. 8 A schematic sectional view of the first alternative embodiment FIG. 9 A second alternative embodiment of a screening device according to the invention in a schematic side view FIG. 10 A third alternative embodiment of a screening device according to the invention in a schematic side view FIG. 11 A fourth alternative embodiment of a screening device according to the invention in a schematic side view

The screening surface 4 runs at an incline to the horizontal plane, wherein the feed region for the material being screened is located on the left-hand side in FIG. 1, but is not marked separately.

The screening surface 4 is formed by a number of screen linings 4*a*. Each screen lining 4*a* is clamped between a first cross member 2 and a second cross member 3. The first and last screen linings 4*a* of the screening surface 4 can be attached differently for this purpose; that is, they do not necessarily need to be clamped between one of the first and second cross members 2, 3. The material being screened can, for example, be fed onto the first screen lining 4*a*, the leftmost screen lining in FIG. 1.

Figure 2:
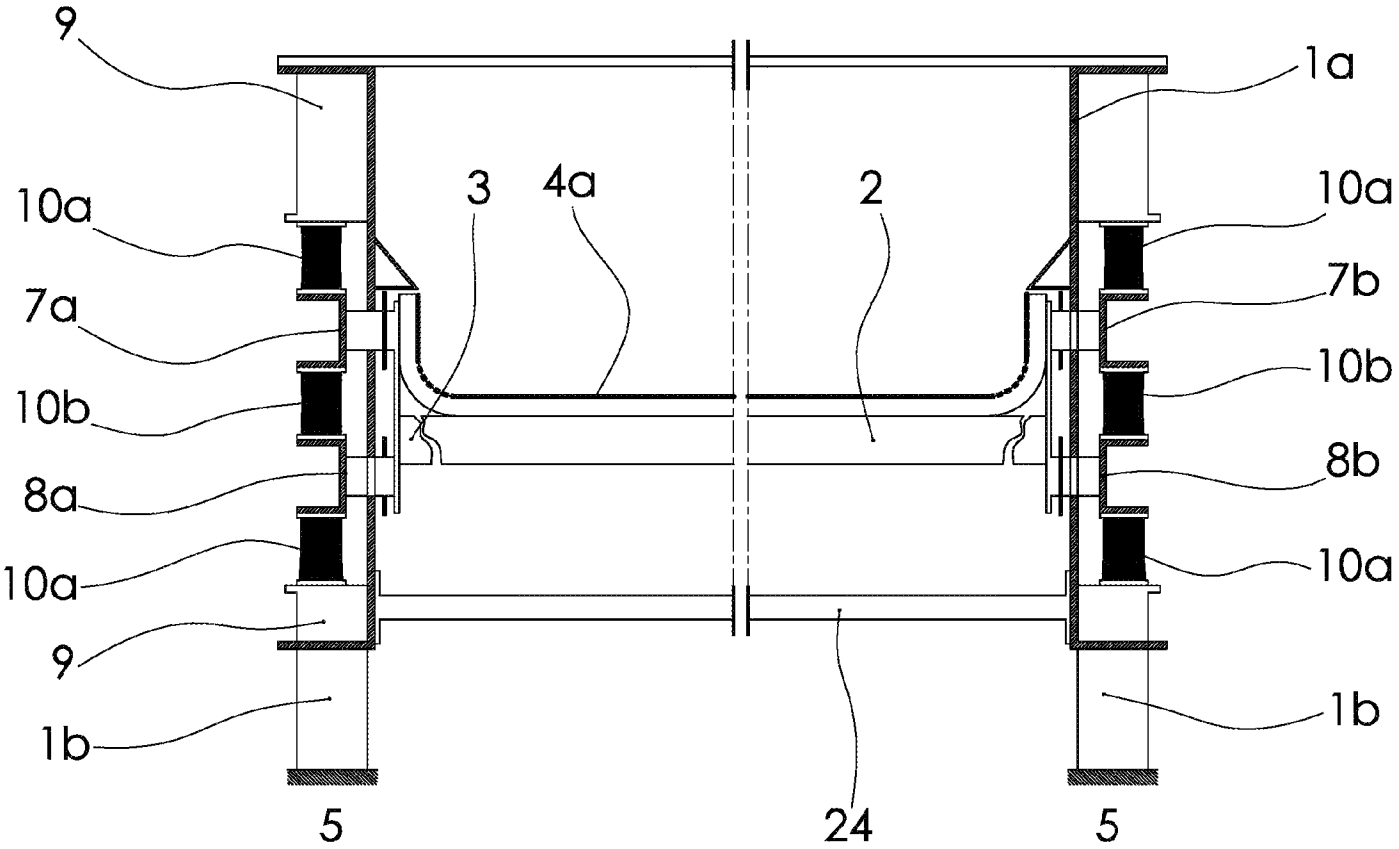

The end regions of the first and second cross members 2, 3 are each connected to one another via push rods 7*a*, 7*b* and 8*a*, 8*b*, respectively, wherein only the push rods 7*a*, 8*a* are visible in FIG. 1. The push rods 7*b*, 8*b* are located on the rear side of the machine in this view. In FIG. 2, a schematic front view, all four push rods 7*a*, 7*b*, 8*a*, 8*b* are visible. For a person skilled in the art, it is therefore clear that the first oscillating body S1 also comprises the pair of push rods 7*a*, 7*b* in addition to the first cross members 2, and that the second oscillating body S2 also comprises the pair of push rods 8*a*, 8*b* in addition to the second cross members 3.

The push rods 7*a*, 7*b*, 8*a*, 8*b* can, for example, be I-beams, H-beams or U-beams, preferably made of steel.

A support structure 1 is used to accommodate the two oscillating bodies S1 and S2. Said oscillating bodies are positioned moveably on the support structure 1 so that they can oscillate relative to the support structure 1. The support structure 1 can be embodied as a load-bearing frame, and can thus be individually adaptable to any desired installation locations. As a result, not only is the classic form of installing the support structure 1 on a horizontal installation surface possible, for example in the form of a machine foundation 5 or the floor of a machine hall, but also on a base running at a slope to the horizontal plane. Furthermore, it is also possible to anchor the support structure 1 alongside the oscillating bodies S1, S2, for example in masonry, so that the oscillating bodies S1, S2 are held in a virtually floating manner above the ground and/or above a collecting container.

Figure 3:
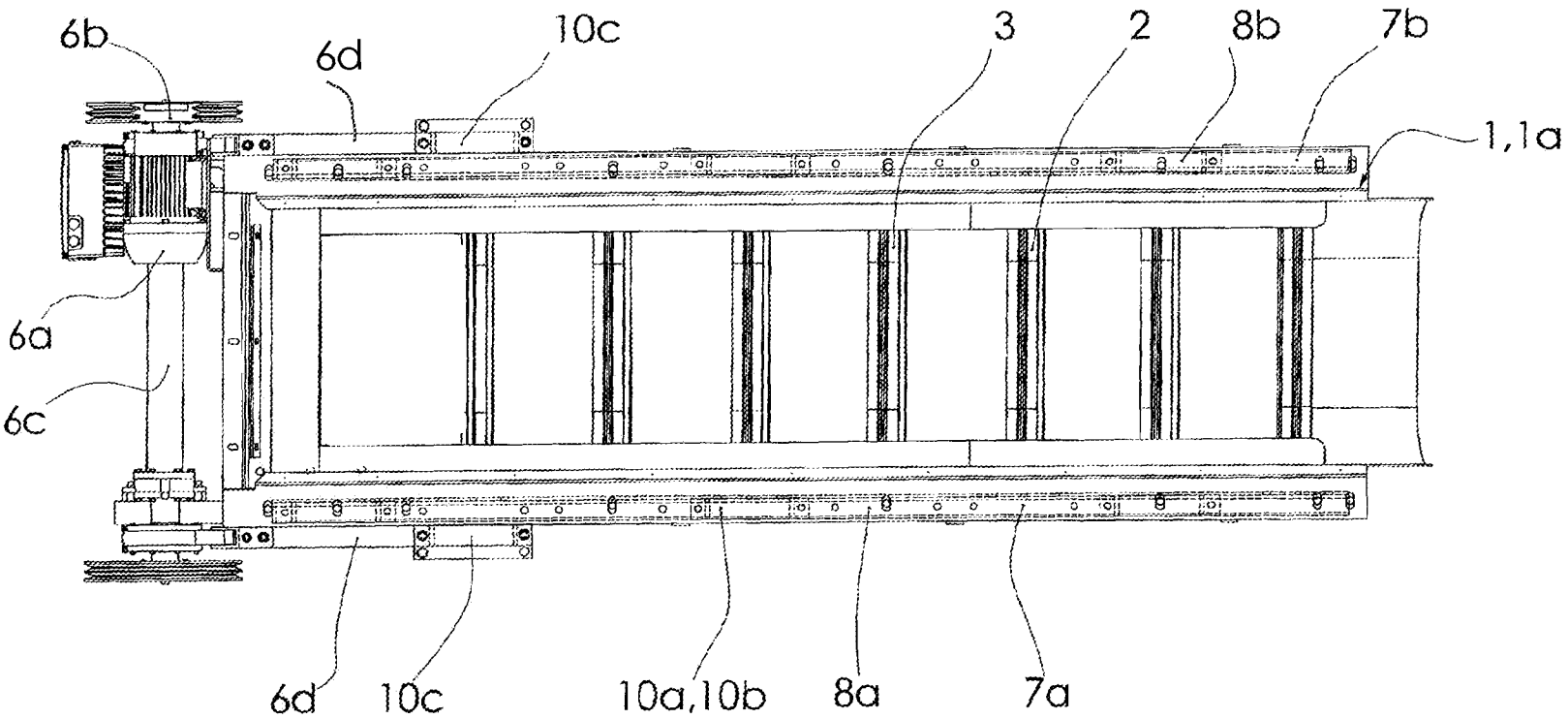

In FIG. 1 through FIG. 3, the classic installation version is shown, namely on a machine foundation 5 or the floor of a machine hall. The support structure 1 itself is embodied as a screen box having support structure walls 1*a*, braces 24, and feet 1*b*, which illustrate a possibility of the inclined configuration of the screening surface 4. Alternatively, the support structure walls 1*a* can also be secured on a sloped foundation so that no feet are necessary.

It should be noted that, in place of the support structure walls 1*a*, frames or frame profiles can also be provided. A planar embodiment of the support structure walls 1*a* is not absolutely necessary.

In the exemplary embodiment according to FIG. 1, the support structure 1 is positioned stationarily on the machine foundation 5 without itself oscillating. The stationary support structure 1 offers the advantage that no energy needs to be spent in order to place said support structure in oscillation. The necessary drive energy for operating the screening device according to the invention can be reduced by approximately ¾ compared to conventional flip-flow screening devices with springable mounting on a base. The machine weight is lighter and the transmission of dynamic forces to the machine foundation is reduced or, in the case of a corresponding mass balance, is eliminated entirely, as will be explained in greater detail below.

The mounting or coupling of the pairs of push rods 7*a*, 7*b*, 8*a*, 8*b* on or to the support structure 1, respectively, occurs via transversely elastic elements 10*a*, in practice also often referred to as rubber blocks for short. Said elements enable an oscillation in the direction of a coupling axis 11, whereas no oscillations occur in directions different therefrom, though said oscillations are merely so small that they can be ignored when considering the overall oscillating behavior of the oscillating bodies S1, S2. The coupling axis 11 preferably runs essentially parallel to the longitudinal axis of the push rods 7*a*, 7*b*, 8*a*, 8*b*. In principle, however, it is also conceivable to enable, through a corresponding fabrication of the transversely elastic elements 10*a*, coupling axes which do not run parallel to the push rods 7*a*, 7*b*, 8*a*, 8*b*.

The push rods 7*a*, 7*b*, 8*a*, 8*b* are thereby supported on consoles 9 of the support structure 1 on the one hand, but also among one another via transversely elastic elements 10*b*.

To put it another way, the pairs of push rods 7*a*, 7*b*, 8*a*, 8*b* are, as can easily be seen in FIG. 1, clamped between the consoles 9 such that said pairs of push rods oscillate, wherein transversely elastic elements 10*a* are provided between the consoles 9 and push rods 7*a*, 7*b*, 8*a*, 8*b*, and transversely elastic elements 10*b* are likewise provided between the top pair of push rods 7*a*, 7*b* and the bottom pair of push rods 8*a*, 8*b*.

The oscillation is excited via a drive unit 6 having a drive 6*c* that is embodied as an eccentric drive. In the exemplary embodiment according to FIG. 1, the drive 6*c* is arranged on the oscillating body S2, specifically on the pair of push rods 8*a*, 8*b*; the other oscillating body S1 is springably coupled to the drive 6*c* through the use of a transversely elastic element 10*c*. The motor 6*a* of the drive unit 6 is arranged on the stationary support structure 1 and coupled to the eccentric drive 6*c* via a V-belt or universal joint drive shaft.

Illustrated by a dashed line are material-feeding or material-removing system components 14*a, b, c* or means 15*a, b, c* for attaching said system components. Said means 15*a, b, c* can, for example, be flanges mounted on the support structure 1, via which flanges the system components 14*a, b, c* can be connected in a fixed manner to the support structure 1 at predefined locations so that the support structure 1 and the system components form a collective screening system.

The system components 14*a, b, c* can be used for the feed or removal of materials or screened product, for example. The system component 14*a* in FIG. 1, for example, is a feed chute via which material that is to be screened can be guided onto the screening surface 4. The system component 14*b* is a discharge shaft via which unscreened material is further conveyed after the screening device. System component 14*c* is used to install a support structure 1 comprising support structure walls 1*a* at a corresponding inclination and, at the same time, to remove the screened material.

Figure 4:
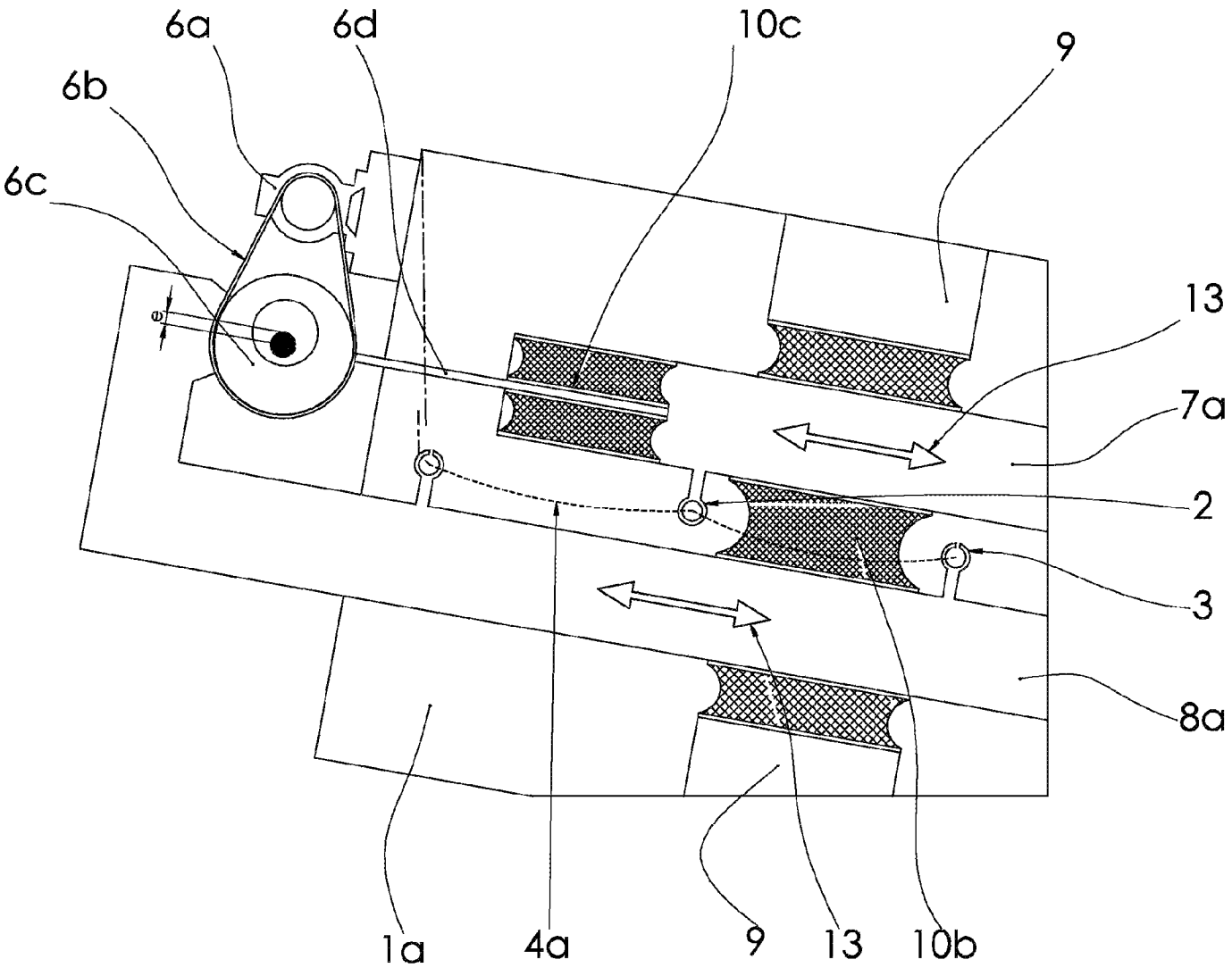

FIG. 4 shows a detailed view of the drive unit 6 from FIG. 1 comprising a motor 6*a* which can preferably be speed-controlled via a frequency converter and which drives the eccentric shaft 6*c* via a belt 6*b*. The oscillating body S1 is connected via the pair of push rods 7*a*, 7*b* and connecting rod 6*d* thereof. In the present exemplary embodiment, laminated wooden leaf springs function as connecting rods 6*d*, which leaf springs are sufficiently flexible and via which the push rods 7*a*, 7*b* are moved back and forth in the direction of the arrows 13. In principle, however, the use of connecting rods made of other materials that exhibit the necessary flexibility is also conceivable. Purely by way of example, the possibility of embodying the connecting rods 6*d* as thin-walled steel springs should be noted at this juncture. The material glass-fiber reinforced plastic is also suitable for the production of glass-fiber reinforced plastic leaf springs with properties similar to the wooden leaf springs, and can therefore be used as connecting rods 6*d* in the present exemplary embodiment.

The connecting rod 6*d* is connected to the pair of push rods 7*a*, 7*b* of the oscillating body S1 by a screw connection of rubber block elements 10*c*, which are secured in the profile of the pairs of push rods 7*a*, 7*b*, to the connecting rods 6*d*, either directly or via an intermediate plate (not illustrated).

The pair of push rods 8*a*, 8*b* is connected directly to the eccentric drive 6*c*, for example by a screw connection of the individual components.

Through the use of the transversely elastic elements 10*a*, 10*b*, 10*c*, a solely linear oscillation of the oscillating bodies S1, S2 is ensured. This enables the use of screen mats 4*a* which are raised at the sides, as can be seen in FIG. 2 in particular.

Figures 5A, 5B, 5C:
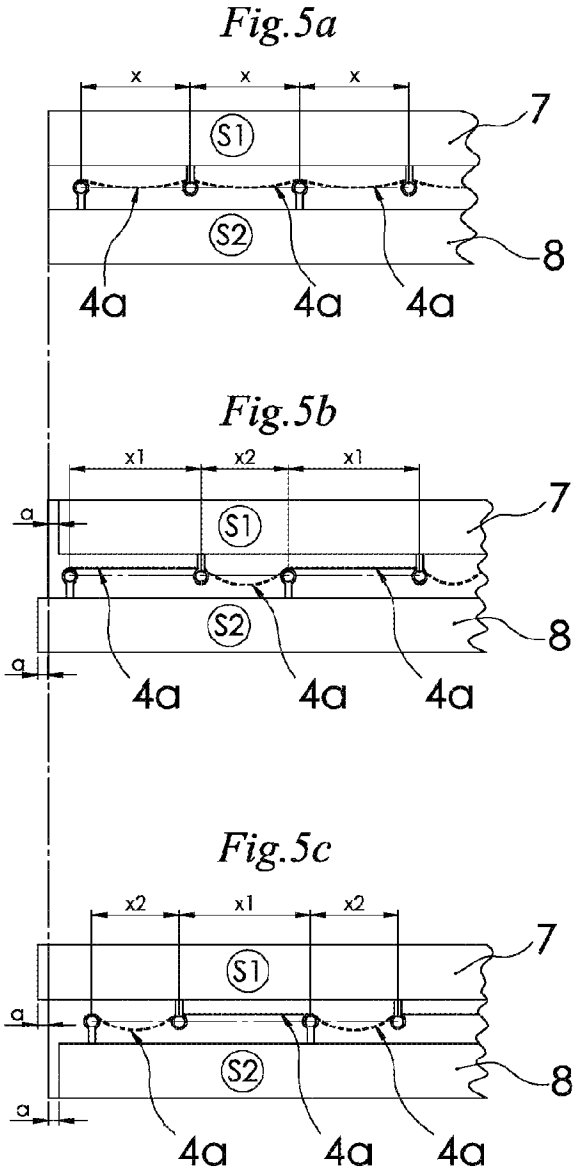

FIGS. 5*a* through 5*c* schematically show the movements of the pairs of push rods 7*a*, 7*b*, 8*a*, 8*b*, and thus the oscillating behavior of the oscillating bodies S1, S2, during the use of a drive 6 as shown in FIGS. 1 through 4. The screening device is thereby operated in the resonance range with a settable operating frequency.

FIG. 5*a* shows the two oscillating bodies S1, S2 in a resting position. In this case, the screen linings 4*a* clamped between the first and second cross members 2, 3 sag slightly. As a result of the eccentric drive 6*c* arranged on the oscillating body S2, the pair of push rods 7*a*, 7*b*, and therefore the oscillating body S1, are set in oscillation via the connecting rod 6*d* on the one hand. At the same time, an oscillation of the elastically mounted oscillating body S2 also occurs.

FIG. 5*b* shows the push rods 8*a*, 8*b* in the—in relation to the resting position in FIG. 5*a*—state thereof in which they are maximally deflected by the oscillation amplitude "a" due to the eccentricity "e" of the eccentric drive 6*c*. In the ideal case of matched masses of the two oscillating bodies S1, S2, the push rods 7*a*, 7*b* are deflected in the opposite direction by the same amplitude "a". Starting with the left screen lining 4*a* in FIG. 5*b*, the screen linings are alternately compressed and expanded as a result of the movements of the pairs of push rods 7*a*, 7*b*, 8*a*, 8*b*, which movements are also accompanied by corresponding movements of the first and second cross members 2, 3, and can therefore easily eject particles clogging the screen openings in the case of screening materials that are difficult to screen.

The matching of the masses of the two oscillating bodies S1, S2 with one another has a great influence on the functioning of the screening device. Only if there is equality of mass between the two oscillating bodies S1, S2 do the forces cancel one another out in the opposing phase-shifted oscillations of the two oscillating bodies S1, S2 and cause no dynamic loads to be transmitted to the support structure 1, whereby said structure can correspondingly have less massive dimensions. For a perfect mass balance, the surplus weight occurring due to the eccentric drive 6 of the oscillating body S2 is compensated on oscillating body S1 by an equalizing weight (not illustrated). In this context, explicit reference is made to the previous explanations for the sake of understanding the term "equality of mass."

As a result of the compression and expansion of the screen linings 4*a* and the inclination of the screening surface 4, the material being screened is conveyed from left to right during screening in the illustrated embodiments. In the operating state, the screening surface 4 is inclined at the angle $\alpha$ to the horizontal plane. The angle $\alpha$ is approximately between 5° and 25°, preferably between 10° and 25°, particularly preferably between 15° and 20°, wherein in this case the straight connection between the clamping locations of the screen linings 4*a* on the first and second cross members 2, 3 is considered to be the screening surface 4, since the actual screening surface 4 formed by the screen linings 4*a* does not constitute a continuously straight surface.

Figure 6:
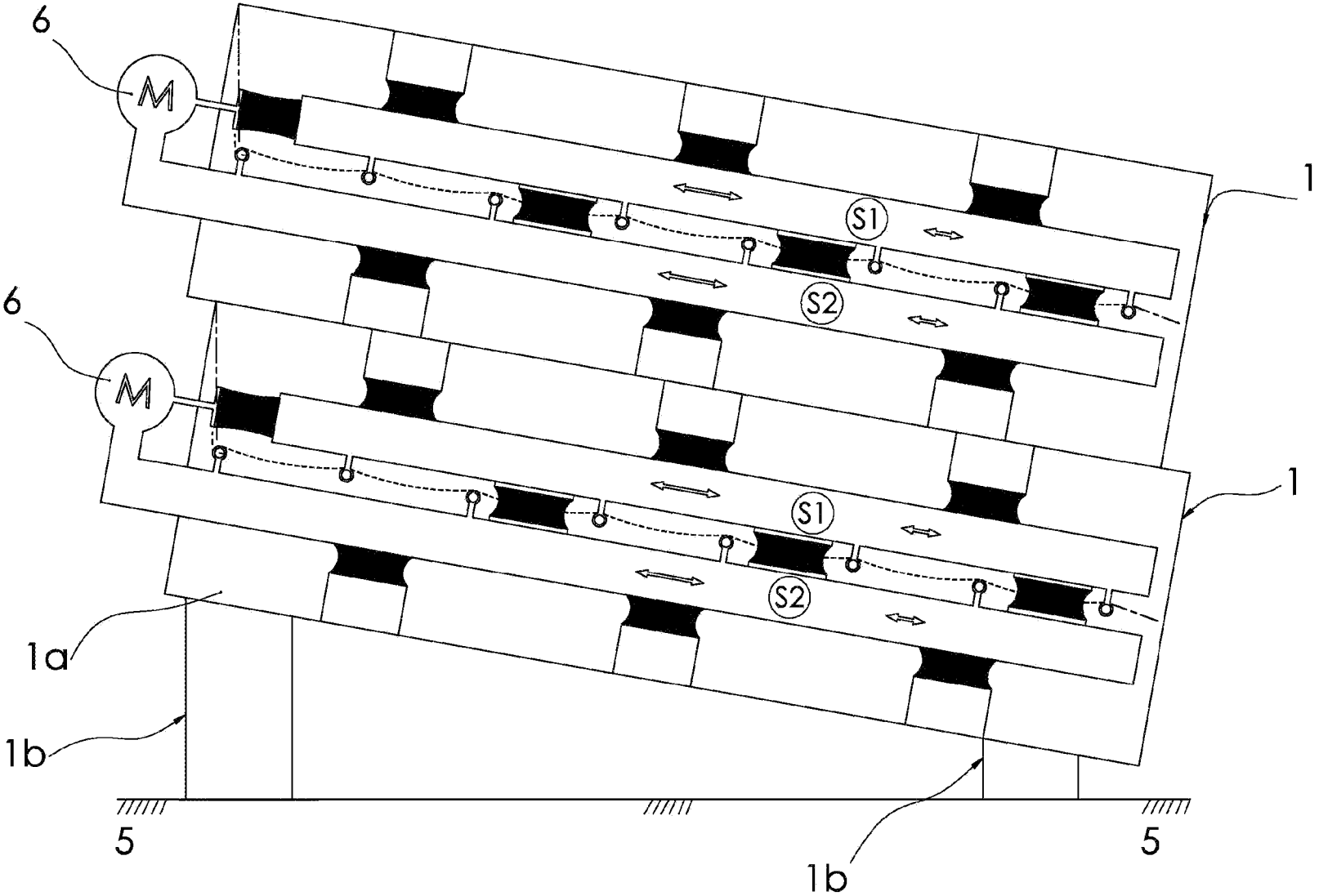

FIG. 6 shows an embodiment in which two screening devices according to the invention are arranged one on top of the other in that the stationary support structure of the one screening device is mounted on the stationary support structure of the other screening device. Not shown are means for connecting and locking the two support structures to one another. Due to the fact that no dynamic loads are transferred to the machine foundation if the oscillating bodies are sized accordingly, more than two support structures of this type, together with oscillating bodies, can also be arranged one on top of the other without critical forces necessitating a height limitation on the stationary support structures in this case.

Figure 7:
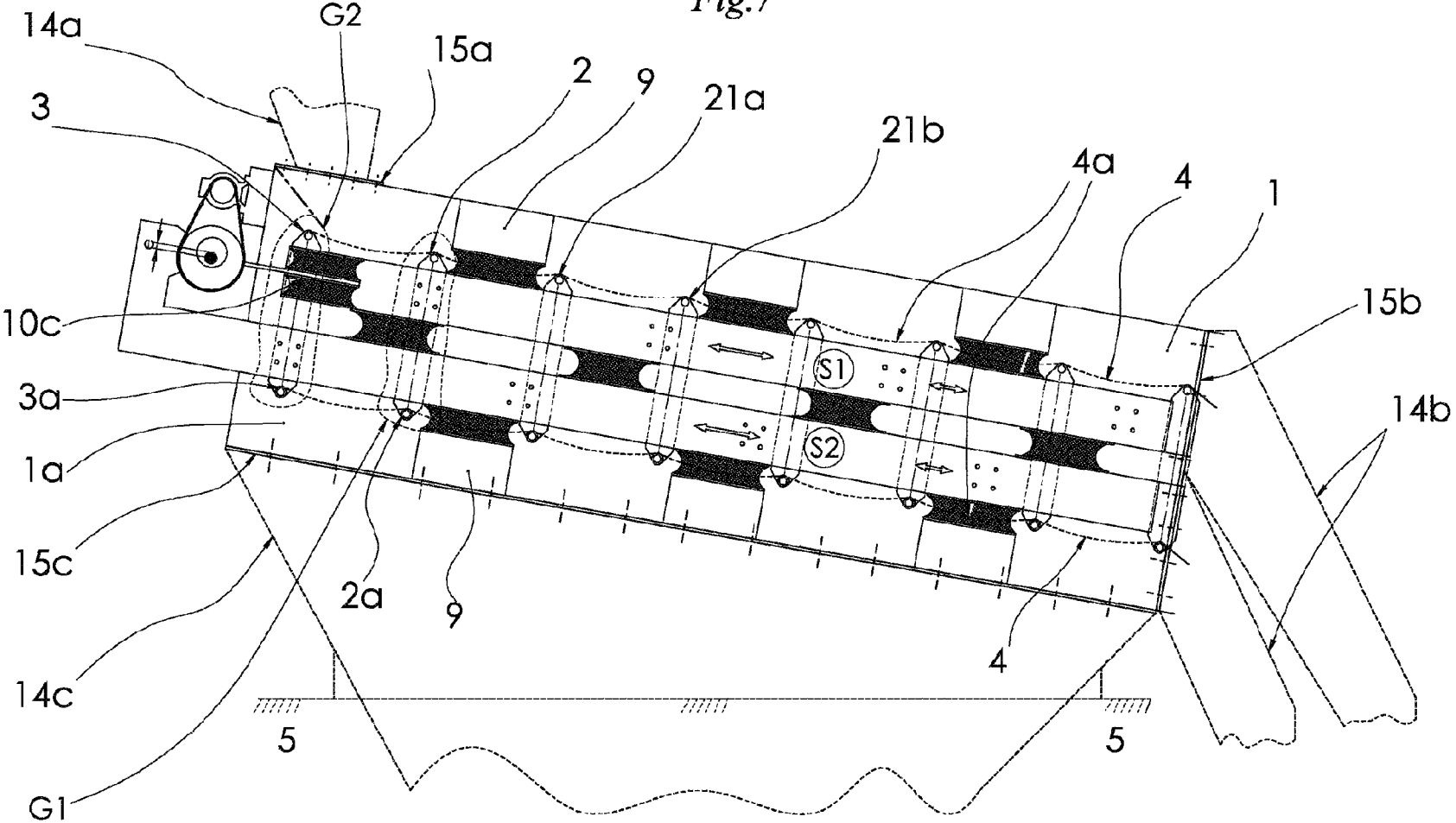

FIG. 7 shows an embodiment of a screening device according to the invention in which two screening surfaces 4 running one below the other are provided, without the constructive effort for the screening device being significantly increased since only two pairs of push rods 7*a*, 7*b*, 8*a*, 8*b* are still used.

At this juncture, it must be emphasized that, in the exemplary embodiment shown, only two screening surfaces 4 are embodied, but that the embodiment of more than two screening surfaces one below the other is in principle also possible.

The simple constructive design is distinguished in that first and second oscillating systems S1, S2 comprise groups G1, G2 of cross members 2, 2*a*, 3, 3*a* arranged one below the other.

Specifically, mounting plates 16*a*, 16*b* are arranged on both sides of the screening surface 4 or screen linings 4*a* on oscillating system S1. On the mounting plates 16*a*, 16*b*, one group G1 of cross members, specifically one first cross member 2 and another first cross member 2*a*, are mounted one below the other.

The same applies to the oscillating system S2. On said oscillating system, a mounting plate 17*a*, 17*b* is likewise arranged on both sides of the screening surface 4 or screen linings 4*a*. On the mounting plates 17*a*, 17*b*, one group G2 of cross members, specifically one second cross member 3 and another second cross member 3*a*, are mounted one below the other.

Figure 8:
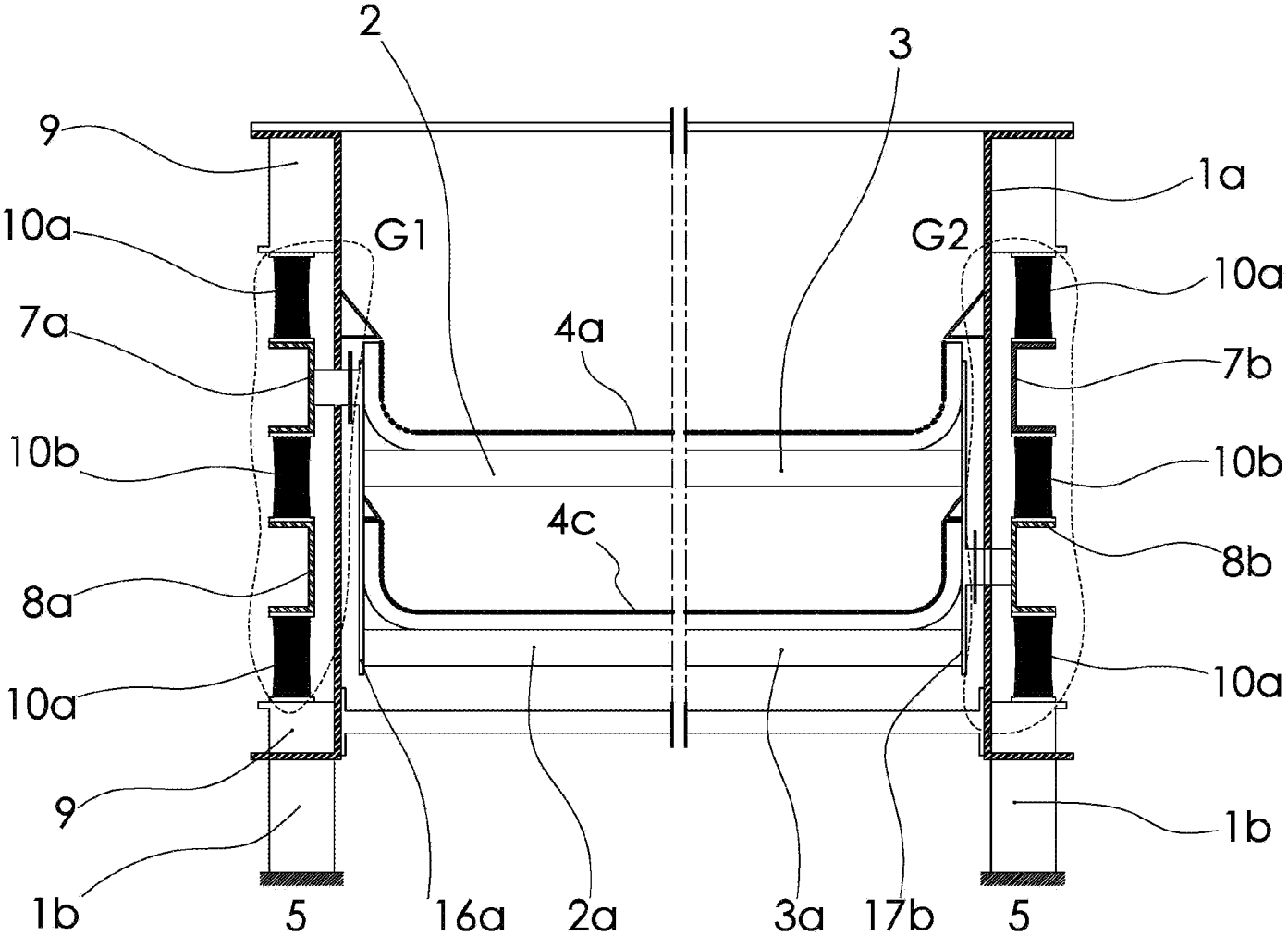

FIG. 8 shows a schematic sectional view through a mounting plate 16*a* on the left-hand side and a schematic sectional view through a mounting plate 17*b* on the right-hand side.

The groups G1 and G2 are arranged along the screening surface 4 in an alternating distribution, so that a screen lining 4*a* is clamped on both a first cross member 2 of a group G1 of the oscillating system S1 and also on a second cross member 3 of a group G2 adjacent thereto of the oscillating system S2.

In contrast to the embodiment of a screening device according to the invention illustrated in FIGS. 1 through 3, an additional screen lining 4*c* is clamped below the screen lining 4*a* in the embodiment illustrated in FIGS. 7 and 8. The screen lining 4*c* is thereby clamped on another first cross member 2*a* of the group G1 and another second cross member 3*a* of the group G2.

In this manner, multiple screening surfaces 4 can be embodied one below the other.

In the exemplary embodiment shown, the mounting plates 16*a*, 16*b* and 17*a*, 17*b* run parallel to the support structure walls 1*b*. The cross members of a group G1 and G2 are secured to the inner side of the mounting plates 16*a*, 16*b* and 17*a*, 17*b*, respectively, that is, on the sides facing the screening surfaces 4. Securing pins 25 are located on the outer sides of the mounting plates 16*a*, 16*b* and 17*a*, 17*b*, which pins are connected to the push rods of the same oscillating system S1, S2 to which the respective mounting plate belongs. In order to connect the mounting plates 16*a*, 16*b* and 17*a*, 17*b* to the appropriate push rods via the securing pins 25, openings are provided in the support structure walls 1*a*.

Figure 9:
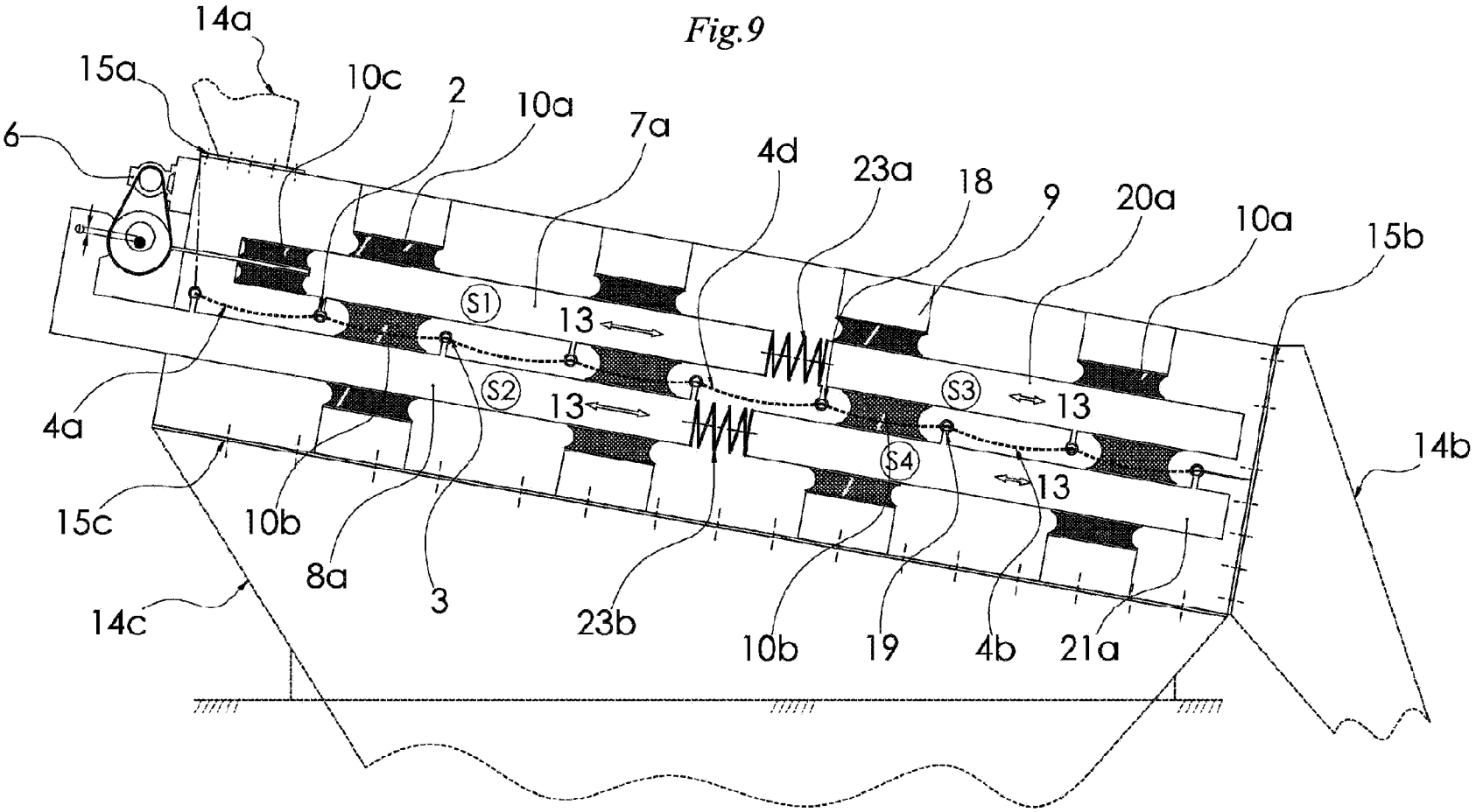

FIG. 9 shows an embodiment of a screening device according to the invention in which two additional oscillating systems S3 and S4 are provided which are embodied in a manner identical as the two oscillating systems S1 and S2 and are coupled to the support structure 1 in an identical manner and also coupled among one other in an identical manner. In addition, the oscillating system S3 is also coupled to the oscillating system S1 and the oscillating system S4 is coupled to the oscillating system S2, namely via springable and/or elastic elements, preferably or specifically via tension-compression springs (23*a*, 23*b*).

Figure 10:
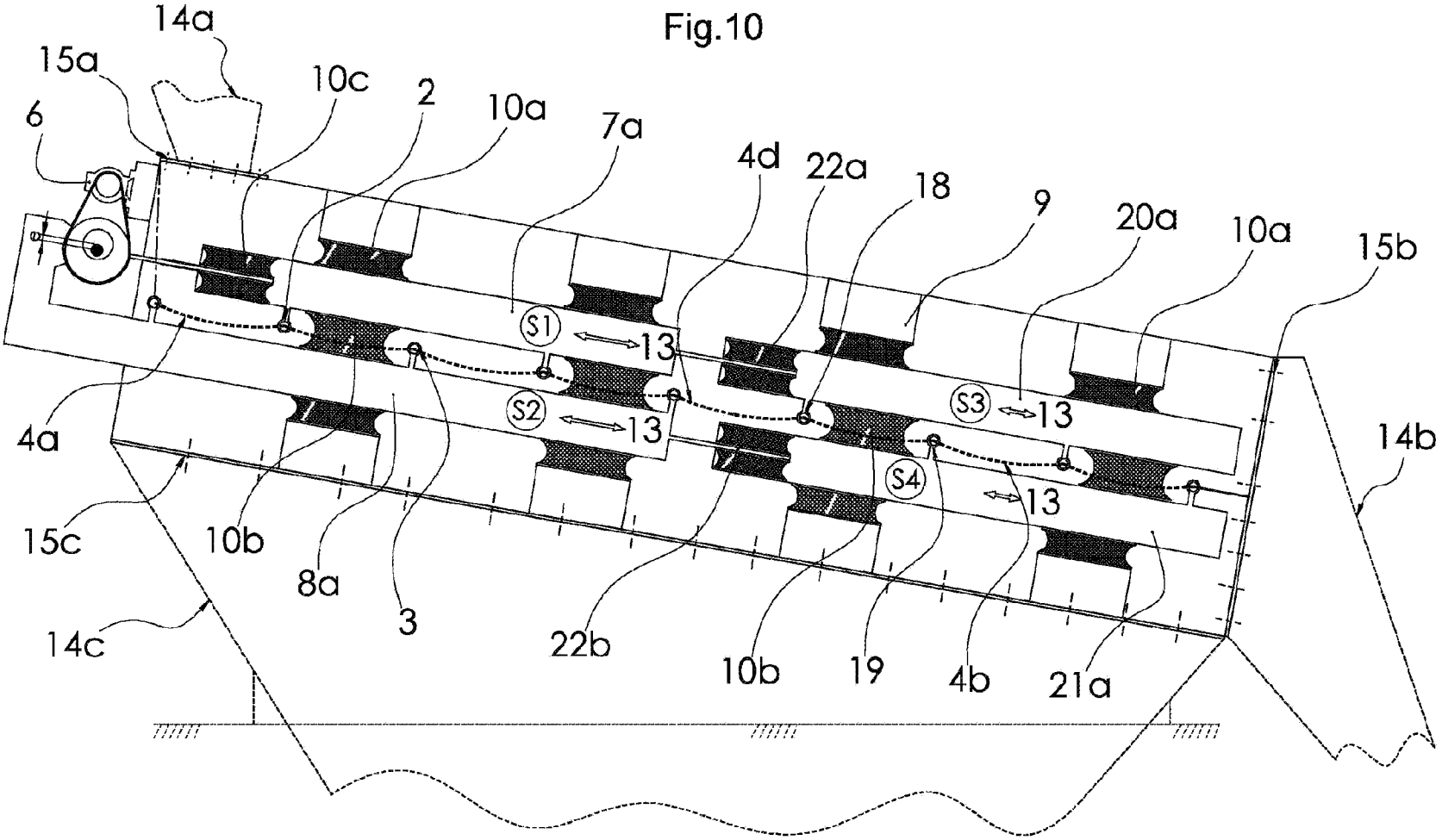

FIG. 10 shows an embodiment of the screening device according to FIG. 9, but with transversely elastic connecting elements 22*a*, 22*b* (similar to 10*c*) in place of the tension-compression spring (23*a*, 23*b*) so that, in accordance with the embodiment illustrated in FIG. 1, a purely linear oscillation of the oscillating systems S1 and S2 occurs.

Through the arrangement of the additional oscillating systems S3, S4, it is possible to embody screening surfaces 4, 26 with different material conveying capacities altogether, whereby the fact is accounted for that a greater material conveying capacity is necessary in the feed region due to the layer height of the material to be screened which prevails there, than in the removal region.

As illustrated in FIG. 4, the screening surface 4 is formed by the screen linings 4*a* of the first and second oscillating systems S1, S2, and another screening surface 26 is formed by the other screen linings 4*b* of the third and fourth oscillating systems S3, S4.

The two screening surfaces 4 and 26 are connected via a screen lining 4*d*.

Through a corresponding design of the elastic or springable connection 22*a*, 22*b*, 23 *a*, 23*b* of the first S1 oscillating system to the third S3 oscillating system and the second S2 oscillating system to the fourth S4 oscillating system, or with a corresponding choice of the mass of the third S3 and fourth S4 oscillating systems, the amplitudes of the pairs of push rods 20*a*, 20*b* and 21*a*, 21*b* of the third S3 and fourth S4 oscillating systems, respectively, can be set to be different from the amplitudes of the first oscillating system S1 and the second oscillating system S2. The amplitude of the removal-side pairs of push rods 20*a*, 20*b*, 21*a*, 21*b* is preferably set to be smaller than that of the feed-side pairs of push rods 7*a*, 7*b*, 8*a*, 8*b*. At this juncture, it should not go unmentioned that, in principle, additional oscillating systems can also be provided in the stationary support structure, which additional oscillating systems are connected to the third and fourth oscillating systems S3, S4 in the same way the third and fourth oscillating systems S3, S4 are connected to the first and second oscillating systems S1, S2.

Figure 11:
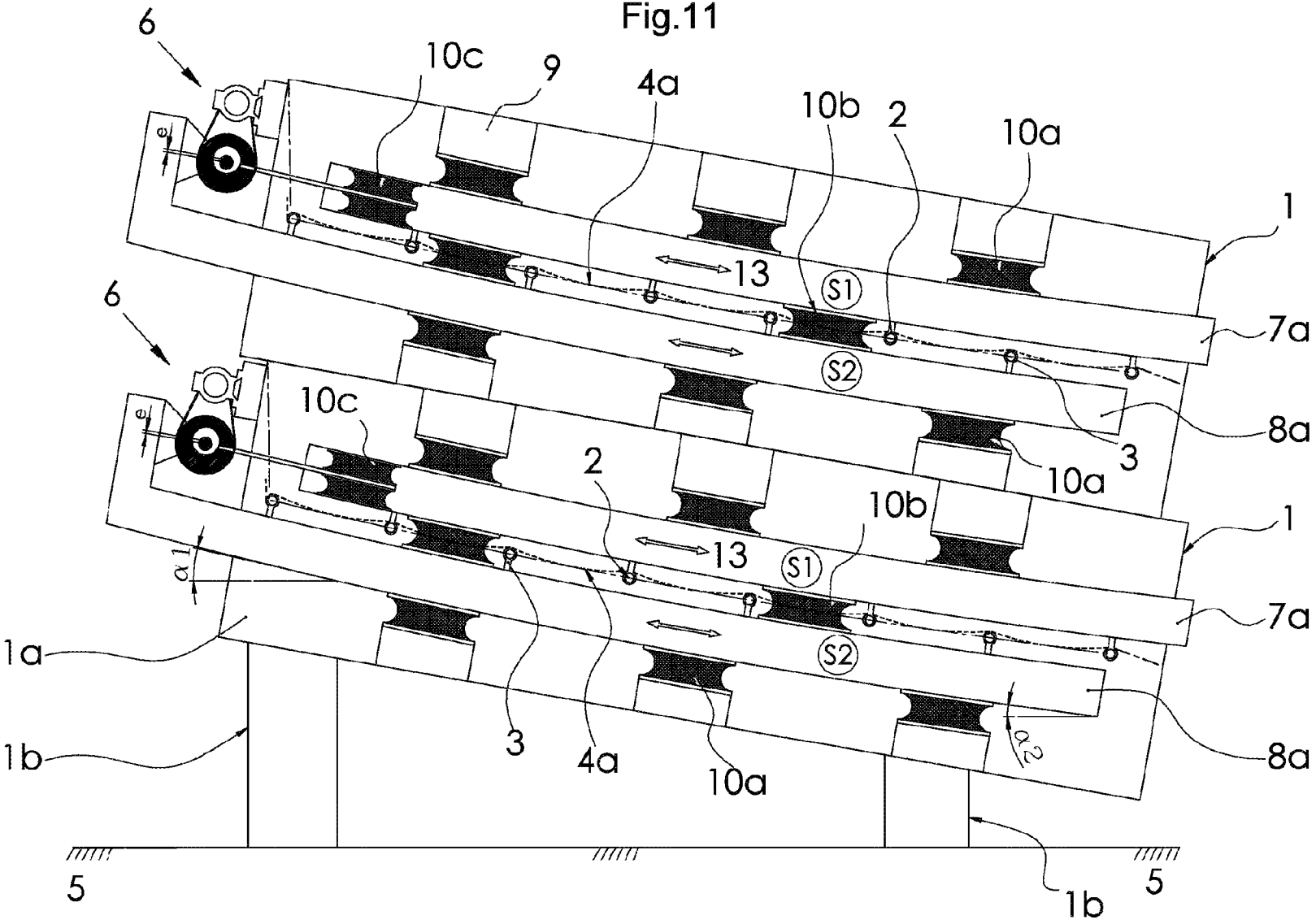

FIG. 11 shows an embodiment in which the screening devices forming the individual screening decks basically correspond to the screening device illustrated in FIGS. 1 through 3, with the difference that the inclination of the screening surface 4 decreases as the screen length increases, as can be seen from the indicated angles $\alpha 1$ and $\alpha 2$, since $\alpha 1 > \alpha 2$. Accordingly, the pairs of push rods 7*a*, 7*b*, 8*a*, 8*b* also have a curved shape. Of course, a single screening device according to the invention, as illustrated in FIGS. 1 through 3, can also comprise a screening surface 4, the inclination of which decreases as the screen length increases.

It is self-evident that the embodiment with multiple stationary support structures arranged one on top of the other, as illustrated in FIG. 6 and FIG. 11, is also feasible for the embodiments of the screening devices illustrated in FIGS. 7 through 9.

In addition, it is clear to a person skilled in the art that, through the use of the transversely elastic elements 10*a*, 10*b*, 10*c*, the embodiments shown in FIGS. 6, 7, 8 and 10 also benefit from a solely linear oscillation of the oscillating bodies S1, S2 and S3, S4, and that the use of screen mats 4*a* and 4*b* with raised sides is thus possible.

LIST OF REFERENCE NUMERALS

1 Support structure
1*a* Support structure walls
1*b* Feet
2 First cross members
2*a* Other first cross members
3 Second cross members
3*a* Other second cross members
4 Screening surface
4*a* Screen lining
4*b* Other screen lining
4*c* Additional screen lining
4*d* Connecting screen lining
5 Machine foundation or platform of a machine hall
6 Drive unit
7*a, b* First pair of push rods
8*a, b* Second pair of push rods
9 Console
10*a* Transversely elastic element
10*b* Transversely elastic element
10*c* Transversely elastic element
11 Coupling axis
12 Feed direction
13 Movement direction of the push rods
14*a* Material-feeding system component
14*b* Material-removing system component
14*c* Material-removing system component
15*a* Means for attaching system components
15*b* Means for attaching system components
15*c* Means for attaching system components
16*a, b* Mounting plates for first cross members
17*a, b* Mounting plates for second cross members
18 Third cross members
19 Fourth cross members
20*a, b* Third pair of push rods
21*a, b* Fourth pair of push rods
22*a, b* Transversely elastic connecting element
23*a, b* Tension-compression spring
24 Braces
25 Securing pin
26 Other screening surface
S1 First oscillating body
S2 Second oscillating body
S3 Third oscillating body
S4 Fourth oscillating body
G1 Groups of cross members arranged one below the other on the first oscillating system
G2 Groups of cross members arranged one below the other on the second oscillating system

The invention claimed is:

1. A screening device comprising:

a first oscillating body comprising first cross members; and a second oscillating body comprising second cross members, wherein the first cross members and second cross members are arranged alternately to a screening surface and each comprises clamping devices via which screen linings which form the screening surface are each clampable between the first cross member and the second cross member, and the first and second oscillating bodies are settable in oscillation relative to one another in order to alternately compress and expand the screen linings, wherein the first oscillating body comprises a first pair of push rods on which the first cross members are arranged and the second oscillating body comprises a second pair of push rods on which the second cross members are arranged and a stationary support structure which accommodates the two oscillating bodies is provided, wherein the first and second oscillating bodies are settable in oscillation relative to the stationary support structure, wherein the first pair of push rods and the second pair of push rods are each coupled to the support structure via transversely elastic elements and are coupled to one another via transversely elastic elements, in which the transversely elastic elements each enable an oscillation in a coupling axis, and wherein the coupling axes of each transversely elastic element run essentially parallel to the push rods.

2. The screening device according to claim 1, wherein the first oscillating body and the second oscillating body are embodied with an equal mass.

3. The screening device according to claim 1, wherein an eccentric drive is provided which drives both the first pair of push rods and also the second pair of push rods.

4. The screening device according to claim 3, wherein the eccentric drive is arranged on the first or second pair of push rods.

5. The screening device according to claim 4, wherein the oscillating body which does not bear the eccentric drive comprises an equalizing weight in order to compensate the surplus weight of the oscillating body which bears the eccentric drive.

6. The screening device according to claim 4, wherein the oscillating body which does not bear the eccentric drive is connected to the eccentric drive via a connecting rod that is connected to a transversely elastic element.

7. The screening device according to claim 1, wherein, on the stationary support structure, material-feeding and/or material-removing system components, or attachment elements attaching said system components, or dust-sealing system components are attached or arranged.

8. The screening device according to claim 1, wherein the first and second oscillation systems comprise groups of cross members arranged one below the other and, in order to form multiple screening surfaces arranged above one another, screen linings are clamped on and between the cross members from groups of the first oscillating system and cross members paired therewith from groups adjacent thereto of the second oscillating system.

9. The screening device according to claim 8, wherein the cross members of each group are attached to mounting plates which are arranged such that they run essentially parallel to the support structure walls.

10. The screening device according to claim 1, further comprising:

a third oscillating body comprising third cross members; and a fourth oscillating body comprising fourth cross members, wherein at least one other screen lining is clampable between one third cross member and one fourth cross member, and the third and fourth oscillating bodies are settable in oscillation relative to one another in order to alternately compress and expand the other screen linings, wherein the third oscillating body comprises a third pair of push rods on which the third cross members are arranged and the fourth oscillating body comprises a fourth pair of push rods on which the fourth cross members are arranged and the first pair of push rods and the third pair of push rods and the second pair of push rods and the fourth pair of push rods are elastically and/or springably connected to one another.

11. The screening device according to claim 10, wherein one push rod of the first pair of push rods and one push rod of the second pair of push rods are each arranged in flush alignment with one another.

12. The screening device according to claim 10, wherein one push rod of the second pair of push rods and one push rod of the fourth pair of push rods are each arranged in flush alignment with one another.

13. The screening device according to claim 10, wherein the third pair of push rods is coupled together with the fourth pair of push rods via transversely elastic elements.

14. The screening device according to claim 10, wherein the third pair of push rods and/or the fourth pair of push rods are coupled to the support structure via transversely elastic elements.

15. The screening device according to claim 10, wherein the elastic and/or springable connection between the first pair of push rods and the third pair of push rods, and/or the second pair of push rods and the fourth pair of push rods respectively occurs by means of a tension-compression spring.

16. The screening device according to claim 11, wherein the elastic and/or springable connection between the first pair of push rods and the third pair of push rods, and/or between the second pair of push rods and the fourth pair of push rods respectively occurs by means of a transversely elastic connecting element.

17. The screening device according to claim 1, wherein multiple support structures are arranged positioned one on top of the other.

18. The screening device according to claim 1, wherein the first cross members and second cross members are further arranged transversely to the screening surface.

* * * * *